US009239144B2

(12) United States Patent
Zwick et al.

(10) Patent No.: US 9,239,144 B2
(45) Date of Patent: Jan. 19, 2016

(54) LIGHT MODULE

(71) Applicant: Automotive Lighting Reutlingen GmbH, Reutlingen (DE)

(72) Inventors: Hubert Zwick, Stuttgart (DE); Hermann Kellermann, Reutlingen (DE)

(73) Assignee: AUTOMOTIVE LIGHTING REUTLINGEN GMBH, Reutlingen (DE)

( * ) Notice: Subject to any disclaimer, the term of this patent is extended or adjusted under 35 U.S.C. 154(b) by 273 days.

(21) Appl. No.: 13/950,632

(22) Filed: Jul. 25, 2013

(65) Prior Publication Data

US 2014/0043840 A1 Feb. 13, 2014

(30) Foreign Application Priority Data

Aug. 9, 2012 (DE) ..... 10 2012 214 138

(51) Int. Cl.
*F21S 8/10* (2006.01)

(52) U.S. Cl.
CPC ..... *F21S 48/1388* (2013.01); *F21S 48/1266* (2013.01); *F21S 48/1358* (2013.01)

(58) Field of Classification Search
CPC F21S 48/1388; F21S 48/1266; F21S 48/1358
See application file for complete search history.

(56) References Cited

U.S. PATENT DOCUMENTS

2005/0086032 A1* 4/2005 Benitez et al. ..... 703/1
2007/0291499 A1* 12/2007 Tanaka ..... 362/509
2008/0316761 A1* 12/2008 Minano et al. ..... 362/518

* cited by examiner

*Primary Examiner* — Elmito Breval
(74) *Attorney, Agent, or Firm* — Howard & Howard Attorneys PLLC

(57) ABSTRACT

The invention concerns a light module with a light source, a primary optical system and a reflector. The primary optical system contains a lens element that is embodied as a sector of an imaginary rotation body formed by the rotation of an imaginary rotation base surface around a rotation axis, wherein the rotation base surface is designed such that the lens element contains a light entry surface that faces the rotation axis and that surrounds the rotation axis and a light emitting surface that is located radially exterior to the rotation axis, wherein the reflector has at least one reflector zone that is embodied as a segment of the surface of a rotation symmetric imaginary associated circular cone, and wherein the axis of symmetry of the circular cone extends parallel to the rotation axis of the lens element.

10 Claims, 6 Drawing Sheets

LIGHT MODULE

CROSS-REFERENCE TO RELATED APPLICATION

This application is based upon and claims priority to German Patent Application 10 2012 214 138.3 filed on Aug. 9, 2012.

BACKGROUND OF INVENTION

1. Field of Invention

The present invention concerns a light module of an illumination device of a motor vehicle. In the present case, a light module is understood to be the core light-emitting unit of an illumination device that emits the desired distribution of emitted light.

2. Description of the Related Art

The state of the art consists of various illumination devices for motor vehicles. A distinction is made here between headlights and lighting devices. Headlights serve primarily for the illumination of the road ahead of the vehicle, but also to increase road safety by making the vehicle visible to other drivers. Consequently, headlights are normally designed for the front of the vehicle. In contrast, lighting devices are primarily designed for road safety purposes by making the vehicle visible to other drivers. Lighting devices may include front lighting devices on the front of the vehicle (such as position light, blinkers) or as rear lighting devices on the rear of the vehicle (such as brake light, back-up light, blinkers). Lighting devices on the side of the vehicle, such as side running lights, are also known.

Depending on the specific application, the distribution of emitted light must satisfy characteristic intensity patterns that will normally be specified by law. Headlights will normally be required to emit a low beam distribution (low beam, fog lights) with a characteristic separation of light and dark or a high beam distribution with illumination of spot areas. Lighting devices may also be desired to have emitted light distributions that illuminate areas with curved or narrow cross sections. Lighting devices may also be designed for wider area coverage or for fan-shaped coverage. The lateral extent of coverage may significantly exceed the density of the area coverage or of the light fan, for example.

In order to produce emitted light distributions with such unconventional spatial dimensions, it is often necessary to use relatively costly designs with several lenses, with fiber optics, with prisms and/or with a large number of reflectors. Given the number of components and the complexity of the design, such solutions will often be very expensive and may require much room.

SUMMARY OF THE INVENTION

The invention has the objective of providing a light module to generate unconventional distributions of emitted light in a simple and cost-effective manner and with a minimum of space.

This objective is solved by the light module that contains at least one light source to emit light and a primary optical system associated with the light source to focus the emitted light in a primary light distribution. Moreover, the light module has a reflector that is designed and incorporated such that the primary light distribution of the primary optical system can be refocused or modified to the emitted light distribution of the light module.

The primary optical system contains a lens element that is embodied as a sector of an imaginary rotation body formed by the rotation of an imaginary rotation base surface around a rotation axis. The rotation base surface is designed such that the lens element contains a light entry surface that faces the rotation axis and that surrounds the rotation axis and a light emitting surface that is located radially exterior to the rotation axis. The reflector has at least one reflector zone that is embodied as a segment of the surface of an imaginary associated circular cone that is symmetric around a rotation axis. The axis of symmetry of the circular cone extends parallel to the rotation axis of the lens element. Thus, the imaginary circular cone is designed as a straight circular cone with a height along its axis of symmetry.

Because the lens element is embodied as a sector of a rotation body and extends around the rotation axis, a relatively large spatial angle can be covered. Specifically, the lens element may surround the entire segment of the light source that emits light. The optical properties of the lens element will be determined by the design of the rotation base surface. If the spatial angle covered by a light source with a conventional lens is to be increased, the thickness of the lens would have to be increased along with its lateral extent in order to maintain its optical properties without change. This would increase the costs of producing the lens and make the lens heavier. However, the lens element of a light module of the invention may be designed to have a relatively thin wall and thus be quite lightweight. Moreover, the thin wall will absorb less of the light such that the light module has a high optical efficiency.

In the present case, a rotation body is understood to be a body formed by the rotation of the underlying level curve—here the rotation base surface—around the rotation axis. The lens element is formed as a segment of the rotation symmetric body containing the rotation axis (sector). Specifically, this sector is delimited by two sector surfaces that intersect along the rotation axis, where the surfaces form a sector angle. The sector angle ranges preferably between 90° and 270°, specifically 180°. However, the term sector includes also the entire sector, which means that the lens element may also be embodied as the complete rotation body around the rotation axis.

The lens element may be used to modify the light of the light source into a wider area of coverage or a fan-shaped coverage that is essentially perpendicular to the rotation axis with a density that is determined by the extent of the rotation base surface along the rotation axis. In this regard, the lens element bordered by a light entry surface facing the rotation axis of symmetry and a light emitting surface that is radially to the exterior relative to the rotation axis of symmetry is designed such that the light distribution emitted by an imaginary point source of light on the light entry surface along the rotation axis is modified to an emitted bundle of light that is contained within a space delimited by the cone surfaces extending rotation-symmetrical around the rotation axis. A suitable design of the rotation base surface will yield an emitted bundle of light within two parallel surfaces that are perpendicular to the rotation axis.

The full primary light distribution may be modified by a spatially constricted reflector into the desired emitted light distribution by targeted reflector zones. The reflector zones may thus be recessed specifically, which will save space. The emitted light distribution will then consist of essentially parallel light rays over a cross section illuminated by the layout of the various reflector zones.

It is preferable that the reflector and its reflector zones will cover only those areas that will be illuminated by the primary light distribution during the operation of the light module.

In order to obtain a lens element with the desired properties, the rotation base surface may be bordered by an interior border facing the rotation axis such that the rotation generates a light entry surface facing the rotation axis. The rotation base surface furthest from the rotation axis may be bordered by a convex exterior border relative to the rotation axis such that the lens element will have a light emitting radially exterior to the rotation axis. Thus the light emitting surface will have a convex shape in cross sections containing the rotation axis. The light entry surface surrounds the rotation axis.

The lens element will preferably consist of optically active lens material, such as transparent material with a higher optical density (larger index of refraction) than air. Possible materials are glass or plastics, such as acrylic glass or polycarbonate. The latter may be particularly cost effective and can be processed with great precision in extrusion processes.

The light source may be embodied as an incandescent bulb with an extended lamp filament. Specifically, such a light source may be designed to extend the lamp filament parallel to the rotation axis or to have the filament extend along the rotation axis. It is also conceivable to use a semiconductor light source, such as an LED with an essentially level light emitting surface. The LED may then be placed such that the light emitting surface extends along the rotation axis or that the rotation axis runs through the light emitting surface. An LED normally illuminates a space described by Lambert's law. It may suffice in this case that the lens element only extends in the emitting area of the LED. Thus it would be feasible to select a sector covering half of the rotation body.

It is preferable that the lens element has an exterior border that is convex in the direction not facing the rotation axis in cross sections including the rotation axis. To this extent, the light emitting surface will be convex in cross sections through the rotation axis. The light entry surface may also be convex relative to the rotation axis, which means that the rotation base surface in this case will have an interior border that is concave on the side facing the rotation axis. In this case, the rotation base surface will be designed with concave-convex lens surfaces. However, the light entry surface may also be level, such that the rotation base surface may also have a plano-convex cross section. A rotation base surface with a biconvex cross section of the convergent lens is also conceivable.

It is preferable to have the rotation base surface symmetrical around the base axis of symmetry, where the base axis of symmetry is perpendicular to the rotation axis of symmetry and intersect the same in an optical center. The rotation base surface will always be derived from the cross section of the lens element in any cross section plane that contains the rotation axis. Thus, the lens element is also designed to be symmetrical around the base symmetry plane, where the base symmetry plane is perpendicular to the rotation axis. The base symmetry plane will be defined by the rotation of the base axis of symmetry around the rotation axis. The intersection of the base axis of symmetry or the base symmetry plane with the rotation axis defines the optical center of the device.

Segments of the rotation base surface may have a lenticular shape, but may also have linear borders, at least in segments. It is also conceivable that the rotation base surface may have alternating adjacent linear and convex borders. Segments of the border of the rotation base surface may be an arc defined in turn by a radius and a center of the circle. The center of the circle will be on the rotation axis of the lens element or between the rotation axis and the lens element. It is also conceivable that the center of the circle will be on the side of the rotation base surface opposite the rotation axis.

The light source will preferable be located in the optical center defined by the intersection of the rotation axis with the base symmetry plane or the base axis of symmetry. The light module focuses the diverging light of an imaginary point light source emanating from this optical center into a space formed by parallel cone-shaped planes. If the light source is embodied as an LED, the optical center would preferably be on the light emitting plane.

If the light source is an incandescent bulb with an extended filament, it is preferable that the filament extends along the rotation axis and through the optical center.

As mentioned above, it is preferable that the rotation base surface of the lens element is symmetrical relative to the base axis of symmetry. It is then characteristic for the lens element that the rotation base surface is designed such that an imaginary base lens derived by rotation of the symmetric rotation base surface around its base axis of symmetry will also have the specified refractive optical properties (assuming the base lens were to be produced from an optically effective lens material). In particular, this imaginary base lens would have light-focusing properties, where the base lens would have a focal length such that the associated focus is on the rotation axis, specifically in the optical center. In this regard, the imaginary base lens has the specific properties of a base converging lens with a focus in the optical center.

However, it is also conceivable that the imaginary base lens has a focal length such that the associated focus is between the base lens and the rotation axis. Likewise, the focus could also be on the opposite side of the base lens relative to the rotation axis.

Depending on the choice of the focal length of the base lens, the lens element generated by rotation will generate various primary light distributions from the light of an imaginary point light source on the rotation axis in the optical center or another light source emitting diverging light bundles.

For example, if the focus is in the optical center, the light emitted by a point source in the optical center will be transformed into a primary light distribution consisting of parallel light rays that are perpendicular to the rotation axis. The density of this fan-shaped primary light distribution will be determined by the extension of the lens element along the rotation axis. However, if the stated focus is between the base lens and the optical center, the lens element will redirect the light emitted by an imaginary point light source in the optical center on a focal line or a segment of the focal line encircling the rotation axis. If the focus is on the opposite side of the base line relative to the optical center, the lens element will redirect the light emitted by a point source situated in the optical center into a diverging emitted light bundle with a reduced divergence angle.

A further embodiment is given by a rotation base surface that is designed such that an imaginary rotation body of the rotation base surface around the base axis of symmetry will have the light-focusing properties of a base lens such that a diverging light bundle emitted by this imaginary base lens from the optical center will focus in a circle extending concentrically around the base axis of symmetry of the imaginary base lens. The imaginary base lens would thus focus the diverging light from a point source to a focal circle. The lens element formed by the associated rotation base surface then has the property that light emitted by an imaginary light source on the rotation axis in the area of the light entry surface will be bundled into two separate spatial ranges that are each bordered by cone surfaces extending from the rotation axis. This lens element may thus be used to generate a light distribution in the shape of a two-part fan. The two parts of the fan will be sequential along the rotation axis.

Moreover, if the listed base lens also has a focus on the associated base axis of symmetry, then the lens element obtained by rotation of the associated rotation base surface will redirect the light of an imaginary point light source on the rotation axis to a light distribution with three fan-shaped light bundles sequentially arrayed along the rotation axis. Thus this design can generate light on three sequential areas of light fans with a variable density along the rotation axis (threefold light fans).

It is preferable that the rotation base surface is designed such that a diverging light bundle emitted from the rotation axis, specifically from the optical center, that illuminates the light entry surface will be redirected to an emitted light bundle with light rays that are parallel on planes including the rotation axis. Such a lens element will generate a light fan or area coverage with constant density. However, it is also conceivable that diverging light bundles emitted from the rotation axis will be redirected to a emitted light bundle of light rays that converge in the planes containing the rotation axis.

Finally, it is also conceivable that the light rays of the emitted light bundle will also diverge, but that the divergence angle of the light rays in those planes that contain the rotation axis will be lower numerically than the divergence angle of the light bundle emitted from the rotation axis.

A particularly preferable embodiment of the light module includes at least one reflector zone in the reflector, where the axis of symmetry of the circular cone associated with the reflector zone as discussed above is on the rotation axis of the lens element. Thus, in this embodiment, both the lens element as well as the reflector zone are at least in some segments rotation-symmetric around the same rotation axis.

In contrast to the embodiments discussed above, the axis of symmetry of the imaginary circular cone associated with the reflector zone may also be tilted relative to the axis of symmetry.

The reflector zone is embodied specifically as a continuous segment extending along an imaginary arc or arc segment around the rotation axis.

The continuous reflector will preferably have a width measured along the rotation axis such that the reflector will catch all of the primary light distribution emitted by the lens element.

The embodiments discussed above will yield a focusing reflector. However, a non-focusing embodiment of the reflector is also conceivable. At least one reflector zone would then have a light-scattering facet or a scattering structure that could be formed by a reflecting surface with a locally different orientation than the circular cone surface, for example.

It is preferable that the reflector will have several different reflector zones. For example, a first reflector zone may be embodied as a segment of the surface of a first rotation-symmetric circular cone, and a second reflector zone may be embodied as a segment of the surface of a second rotation-symmetric circular cone. The first circular cone will differ from the second circular cone. This will facilitate a separation of light distributed from a lens element as a fan into two separate lit areas by the reflector zones, such as into two lit rings.

It is preferable that all axis of symmetry of the imaginary circular cones associated with the reflector zones coincide. In particular, the axis of symmetry all extend along the rotation axis, where the various circular cones apply at different positions along the rotation axis relative to each other, which means that the origins of the various cones are in different positions along the rotation axis.

Regarding a first and second reflector zone, the second reflector zone will specifically be situated such that (meaning that the segment of the second imaginary circular cone will be chosen such that) a projection perpendicular to the rotation axis will show that the second reflector zone will be immediately adjacent to or will overlap with the first reflector zone. However, the second reflector zone will be offset in a radial direction regarding the rotation axis relative to the first reflector zone.

In particular, the various circular cones will have the same included angle. If the circular cones are offset along the rotation axis, the reflector zones will be parallel to each other, but in different radial distances from the rotation axis.

However, the various circular cones may also have different included angles. As a result, the corresponding reflector zones will normally no longer be parallel. This will make it possible to redirect light output into different directions.

Embodiments may also be advantageous where the various reflector zones will be associated with imaginary rotation-symmetric circular cones with different axis of symmetry. It is preferable that these different axis of symmetry will be parallel to each other and/or to the rotation axis, but offset parallel to each other. Finally, embodiments are also conceivable where the axis of symmetry of the imaginary circular cones will be tilted towards each other.

The reflector may have a variety of reflector zones as described, where the various reflector zones are situated along a reflector guide curve. This reflector guide curve may be non-linear, specifically circular. To place the reflector zones along the reflector guide curve, a zone reference point may be defined for each reflector zone, such as a center or a defined corner of a particular reflector zone, specifically embodied as a polygon. The zone reference points of the various reflector zones will then be on the reflector guide curve.

Each of the many reflector zones in turn is a segment of the surface of an imaginary rotation-symmetric circular cone. Depending on the configuration of the reflector guide curve, the circular cones associated with the reflector zones will then be offset, such as along the reflector guide curve. In particular, the various circular cones will have the same included angles. It is preferable that the axis of symmetry of the various circular cones will be parallel to each other. The specified reflector guide curve may be a circle, for example, that intersects the rotation axis in a guide interface. The guide interface will specifically be in the specified optical center of the unit, that is it coincides with the intersection of the base symmetry plane or the base axis of symmetry and the rotation axis.

Moreover, embodiments are conceivable where the several different imaginary circular cones had different included angles. The associated axis of symmetry may be tilted against each other.

The respective reflector zone will be designed in all embodiments specifically such that the light emitted from the lens element with the primary light distribution will be redirected in a direction along the rotation axis. This defines a main direction of light emitted from the light module. If the lens element is designed such that the light rays of the primary light distribution are essentially perpendicular to the rotation axis, then the circular cone associated with the reflector zone will preferably have an included angle of 45°.

In order to manufacture the reflector of the light module of the embodiments described above, the various reflector zones may be designed to be on a single reflector body. This reflector body may be produced by extrusion molding, for example, preferably in plastic, where the various reflector zones are formed on a surface of the reflector body.

BRIEF DESCRIPTION OF THE DRAWINGS

Further details and advantageous embodiments of the invention are provided in the following description, which describes and elaborates on the embodiments of the invention with reference to the Figures.

DETAILED DESCRIPTION OF THE EMBODIMENTS OF THE INVENTION

The following description will use common reference marks for identical or similar components and characteristics for better presentation.

Figure 1:
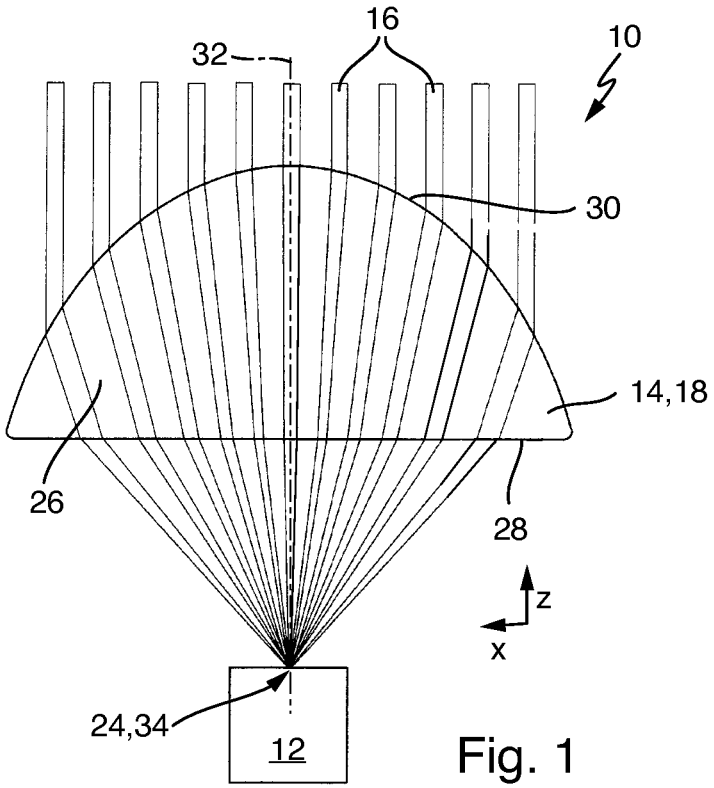
FIG. 1 a detail view of a light module with a cross section of a lens element.
Figure 2:
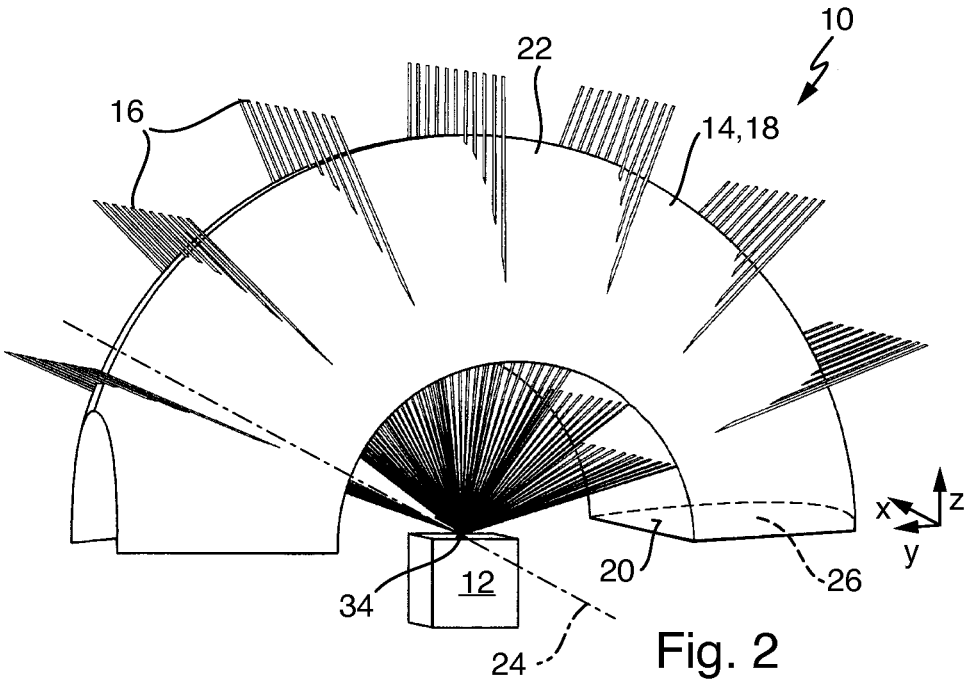
FIG. 2 a detail view of the light module of FIG. 1 in a side view.

FIGS. 1 and 2 show a segment of light module 10 according to the invention as it may be used in a motor vehicle illumination device, for example.

The following explanation is based on a right-handed Cartesian coordinate system as shown in FIGS. 1 and 2, for example, in addition to light module 10.

Light module 10 initially includes light source 12 to generate light and primary optical system 14 as an auxiliary lens system by means of which light emitted by light source 12 can be bundled into primary light distribution 16.

Primary optical system 14 includes lens element 18. However, primary optical system 14 may also contain additional optically functional elements. Lens element 18 includes light entry surface 20, through which light from light source 12 can be captured in lens element 18. Furthermore, lens element 18 has light emitting surface 22, through which light exits from lens element 18 to be distributed as primary light distribution 16.

As FIG. 2 indicates, the lens element is embodied as a sector of a torus-shaped rotation body around rotation axis 24. Rotation axis 24 extends along the x-axis in terms of the selected coordinate system.

The rotation body is generated by rotating rotation base surface 26 around the rotation axis (x-axis). FIG. 1 shows rotation base surface 26 in the cross section on the x-z-plane of the coordinate system. Of course, every cross section through lens element 18 along any plane including rotation axis 24 will yield a presentation of rotation base surface 26 as shown in FIG. 1. Lens element 18 is embodied as a sector extending over half of the imaginary rotation body (relative to the selected coordinate system, the half along the positive z-axis).

Rotation base surface 26 is bordered by an inner border 28 facing rotation axis 24 that is essentially linear and parallel to the x-axis (rotation axis 24). In the direction opposite rotation axis 24, rotation base surface 26 is bordered by outer border 30 that is convex relative to rotation axis 24. Given that lens element 18 is embodied as a rotation body of rotation base surface 26, light entry surface 20 surrounds rotation axis 24 in the manner of a (semi-)cylindrical surface. Light entry surface 20 is thus circular in the y-z-plane, but linear in all planes containing rotation axis 24. Light emitting surface 22 is circular in cross sections parallel to the y-z-plane and lenticular convex in cross sections through rotation axis 24. Rotation base surface 26 thus has a plano-convex convergent lens cross section.

The cross section depicted in FIG. 1 shows rotation base surface 26 as symmetric relative to base axis of symmetry 32. Base axis of symmetry 32 is perpendicular to rotation axis 24 and intersects the same in optical center 34. In terms of the selected coordinate system, the base axis of symmetry 32 is parallel to the z-axis.

Lens element 18, which is embodied as a rotation body of rotation base surface 26, is thus symmetric to a base symmetry plane extending parallel to the y-z-plane and also intersects rotation axis 24 in the optical center 34.

Light source 12 is positioned such that the segment of light source 12 emitting light is in the area of optical center 34.

Rotation base surface 26 is designed such that diverging bundles of light emanating from optical center 34 are redirected by lens element 18 such that the associated emitted light bundle of primary light distribution 16 consists essentially of parallel light rays. Thus, lens element 18 redirects the light bundle emanating from rotation axis 24 in a primary light distribution 16, which consists of parallel light rays in the cross sections containing rotation axis 24 in each case (see FIG. 2).

Figure 3:
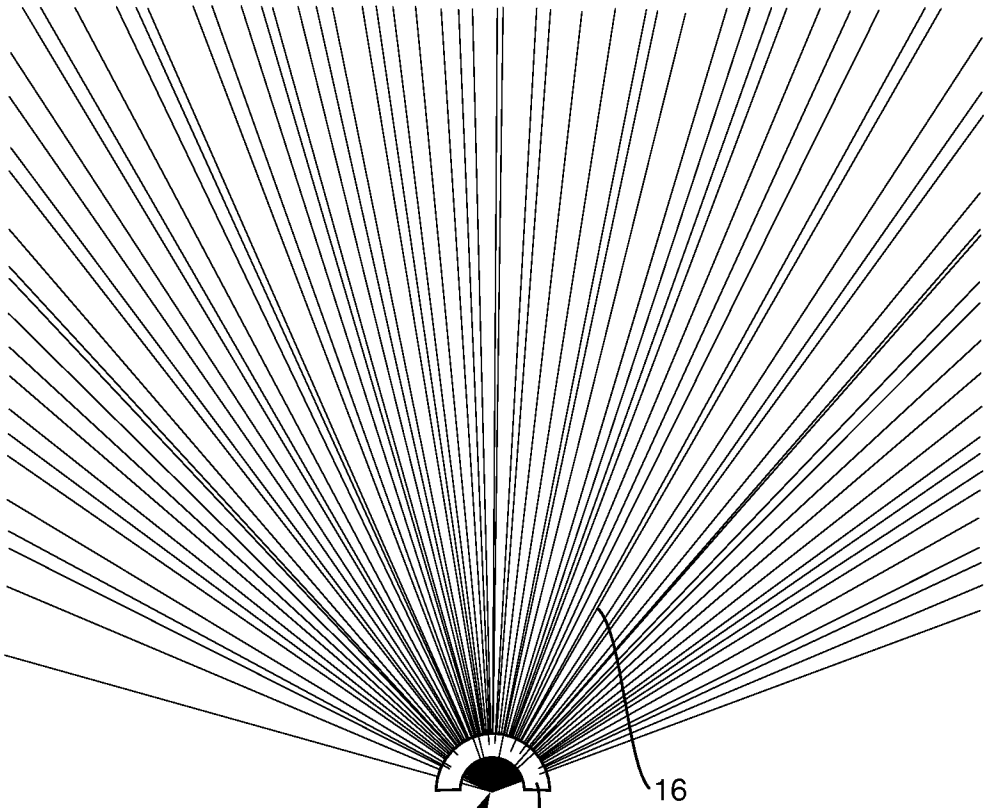
FIGS. 3 and 4 schematic views to explain the primary light distributions of the light module of FIGS. 1 and 2
Figure 4:
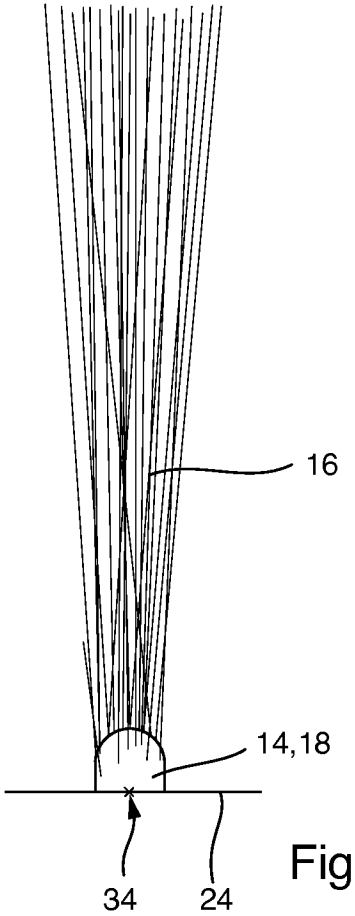

FIGS. 3 and 4 show the primary light distribution 16 that can be obtained with lens element 18 from the diverging emitted light of light source 12 located in the optical center 34. FIG. 3 shows here a view perpendicular to rotation axis 24. FIG. 4 shows a side view perpendicular to rotation axis 24. It is obvious that primary light distribution 16 is limited to an area that extends essentially between two planes perpendicular to rotation axis 24. Thus, lens element 18 is designed such that the light emitted by a point light source situated in the optical center 34 can be redirected to an essentially constant light fan or wider area coverage, where the density along rotation axis 24 will be determined by the dimensions of lens element 18 along rotation axis 24.

Figure 5:
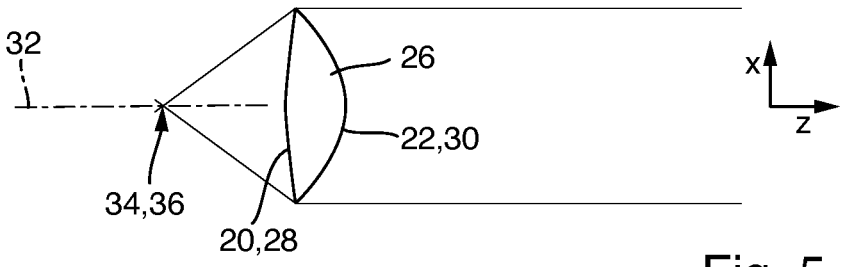
FIG. 5 a schematic view to explain an embodiment of the lens element.
Figure 6:
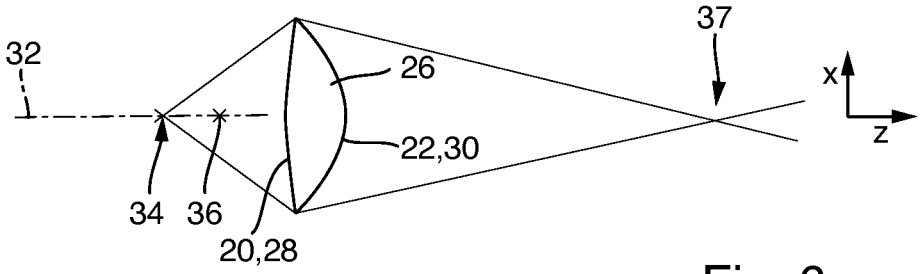
FIG. 6 a schematic view to explain a different embodiment of the lens element.
Figure 7:
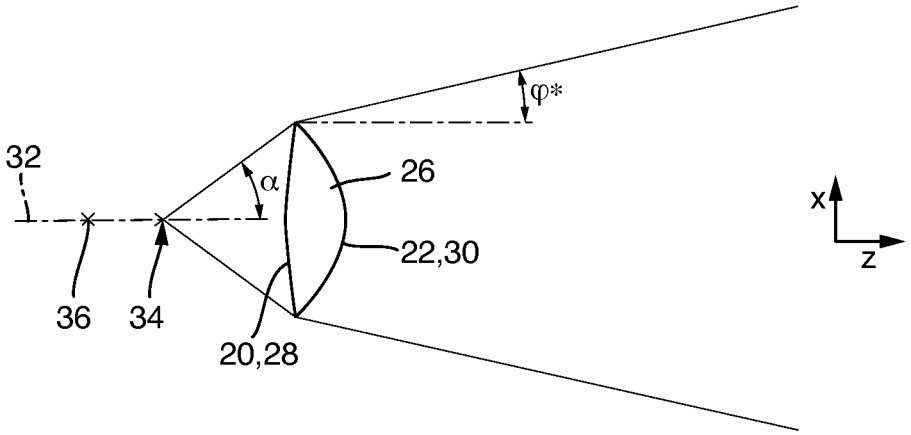
FIG. 7 a schematic view to explain yet another embodiment of the lens element.

FIGS. 5 to 7 show three conceivable embodiments for rotation base surface 26 and the resulting properties of lens element 18.

Rotation base surface 26 has a converging lens cross section in these three depicted instances, and it is bordered by the convex interior border 28 and the convex exterior border 30. Rotation base surface 26 is again symmetric relative to base axis of symmetry 32. The discussion of optical properties is based on an imaginary base lens generated by the rotation of rotation base surface 26 around base axis of symmetry 32.

FIGS. 5 to 7 show that the base lens associated with rotation base surface 26 will in each case have a focus 36.

It is assumed for the following discussion that the optical center denoted as 34 contains a point light source that emits a diverging light bundle. The optical properties of the device then depend critically on the position of optical center 34 and focus 36 relative to each other.

FIG. 5 shows that rotation base surface 26 is designed such and that it is placed such relative to optical center 34 that optical center 34 and focus 36 coincide. Consequently, a diverging light bundle emitted from optical center 34 will be redirected into a light bundle consisting of light rays that extend parallel to axis 32. Thus, lens element 18 generated from rotation base surface 26 is capable of generating primary light distribution 16 in the manner shown in FIGS. 1 to 4.

Focus 36 is shown in FIG. 6 between optical center 34 and rotation base surface 26. Consequently, a diverging light bundle emitted from optical center 34 will be redirected into a light bundle consisting of light rays that meet in output focus 37. Thus, lens element 18 generated from rotation base surface 26 will redirect the light from light source 12 located in optical center 34 into primary light distribution 16, which is concentrated beyond light emitting surface 22 in a focus line defined by the rotation of output focus 37 around rotation axis 24. The light rays of primary light distribution 16 will diverge beyond the focus line. Thus, primary light distribution 16 will be bordered between two rotation-symmetric cone surfaces around rotation axis 24, where the associated imaginary cones are open in opposite directions along rotation axis 24 and will intersect each other.

Finally, FIG. 7 shows a focus 36 on the side of optical center 34 opposite rotation base surface 26. Thus, optical center 34 is between focus 36 and rotation base surface 26. A diverging light bundle emanating from optical center 34 will in this situation be redirected by the base lens formed by rotation base surface 26 into a likewise diverging output light bundle (divergence angle ($\phi^*>0$). If lens element 18 is generated from rotation base surface 26 in this manner, the lens element 18 will serve to generate a primary light distribution 16 that is bordered by two cone surfaces that extend symmetrically around rotation axis 24 and that diverge from optical center 34.

Thus, FIG. 5 describes a light fan of constant density along rotation axis 24, whereas FIGS. 6 and 7 show a light fan with a measured density that will vary along rotation axis 24 with the radial distance from rotation axis 24.

Figure 8:
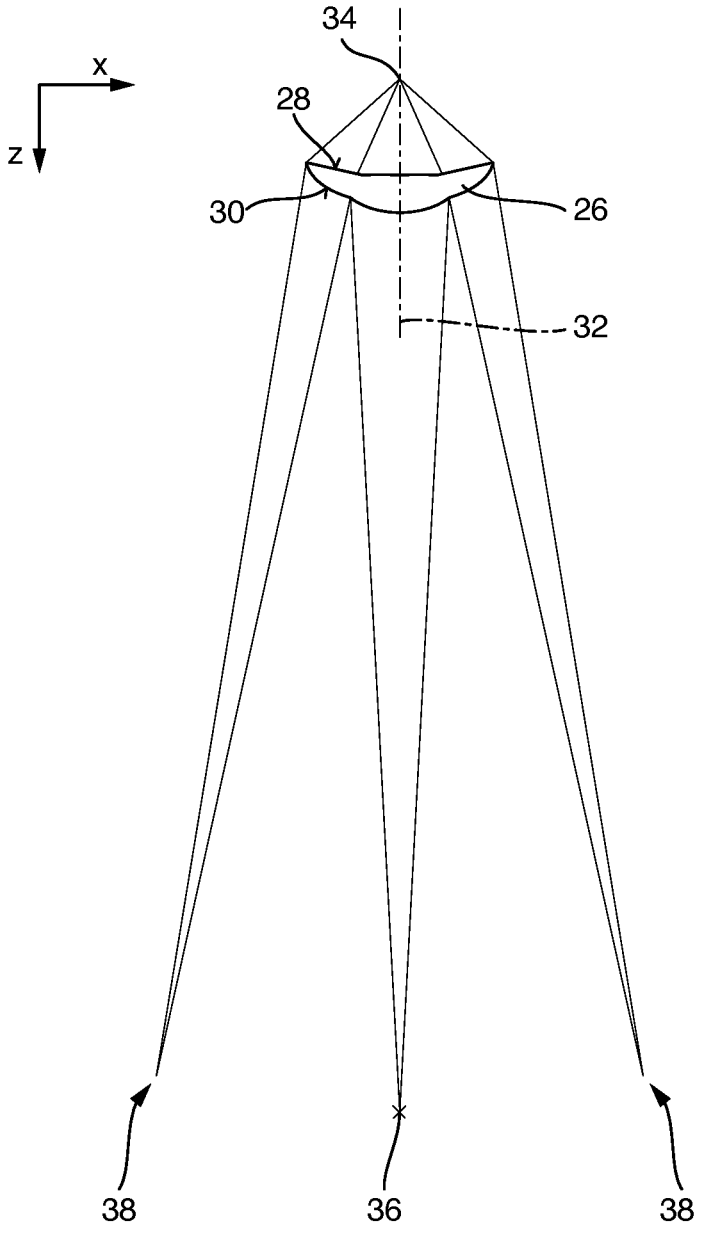
FIG. 8 a schematic view to explain yet another embodiment of the lens element.

FIG. 8 shows another example for the design of rotation base surface 26. The inner border and the outer border 30 each have segments with different radii. Rotation base surface 26 has essentially a concave-convex converging lens cross section, and it is symmetric around base axis of symmetry 32. The shape of rotation base surface 26 is such that an imaginary rotation body of rotation base surface 26 around the x-axis (rotation axis) will redirect a diverging light bundle emanating from optical center 34 to a central focus 36 around the x-axis as well as to two different foci 38 that are before and after focus 36 along the x-axis (thus a total of three successive foci along the x-axis).

Rotation base surface 26 is specifically shaped such that an imaginary rotation body of rotation base surface 26 around the base axis of symmetry 32 (the so-called "base lens") will redirect a diverging light bundle emanating from optical center 34 onto focus 38 as well as onto focus 36.

If a lens element 18 is produced from rotation base surface 26 in the shape shown in FIG. 8, primary light distribution 16 will have three light bundles at successive spots along rotation axis 24, each of which will be bordered by cone surfaces. This will produce a threefold light fan.

Figure 9:
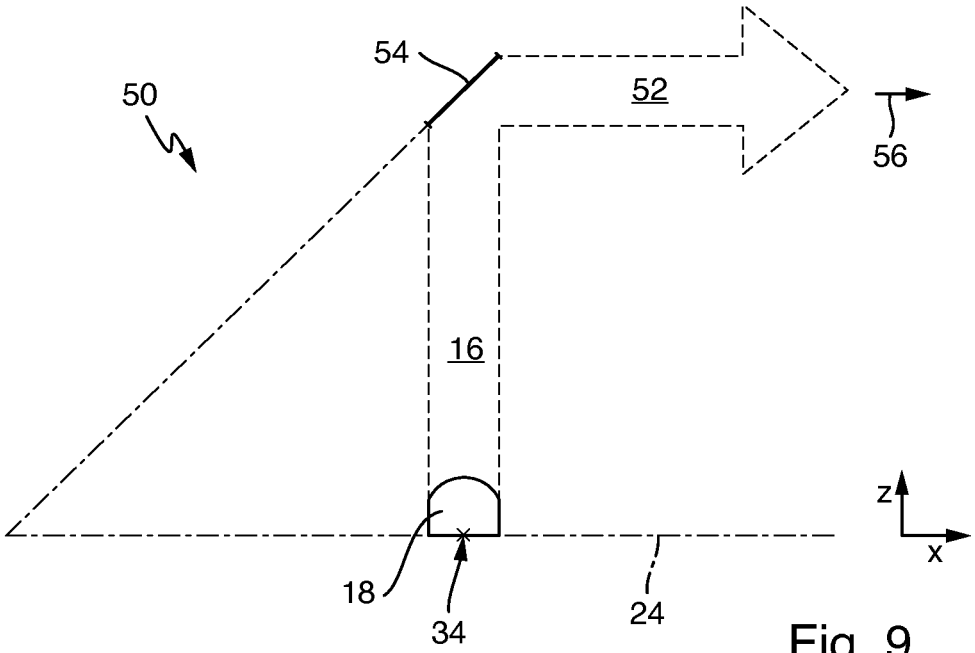
FIG. 9 another embodiment of a light module according to the invention.

FIG. 9 shows a light module 50 that includes a lens element 18 of the type described in FIGS. 1 to 4, for example. A light source, which is not described in more detail, is located in optical center 34. Light module 50 also contains a reflector designed to redirect primary light distribution 16 into emitted light distribution 52 of light module 50.

The reflector includes a reflector zone 54 embodied as a segment of the surface of an imaginary straight circular cone around rotation axis 24. Rotation axis 24 is thus both the axis of symmetry for the rotation body underlying lens element 18 as well as for the circular cone underlying reflector zone 54. However, the design and dimensions of primary optical system 14 is fundamentally independent of reflector zone 54. The associated imaginary circular cone may also be symmetric around an axis of symmetry, which differs from rotation axis 24.

The circular cone underlying reflector zone 54 has a cone included angle of 45° relative to rotation axis 24 in the present example. Thus, a main emitting direction 56 is defined for light module 50 that is essentially parallel to rotation axis 24 and essentially perpendicular to the fan-shaped primary light distribution 16.

Reflector zone 54 may be embodied as a band-like segment extending along an arc around rotation axis 24. The band-like segment has a width just sufficient to generate light coverage across its entire area. Cross sections containing rotation axis 24 will thus always have the configuration depicted in FIG. 9. Light module 50 will thus yield illumination of an area covered by emitted light distribution 52 with a striped or semicircular or ring-shaped design.

Figure 10:
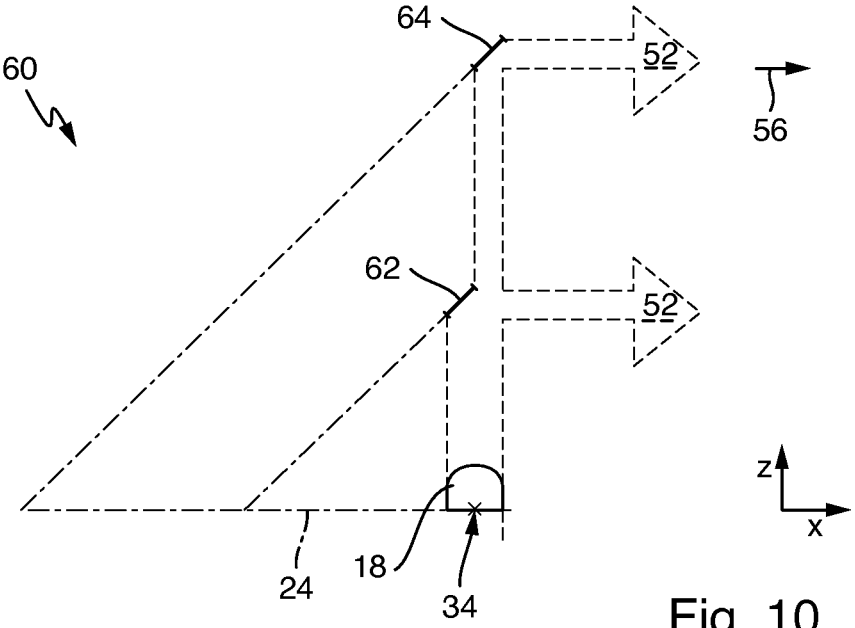
FIG. 10 yet another embodiment of a light module according to the invention.

FIG. 10 shows a light module 60 that differs from light module 50 by having a first reflector zone 62 and a second reflector zone 64 that differs from the first reflector zone 62. Both reflector zones 62 and 64 are again segments of the surface of a first and a second imaginary straight circular cone. Both circular cones have the same included angle relative to rotation axis 24, which is 45° in the present example. The two imaginary circular cones are offset against each other along rotation axis 24. The segments of the imaginary circular cones underlying reflector zones 62 and 64 are chosen such that a projection perpendicular to rotation axis 24 will show the second reflector zone 64 as immediately adjacent to the first reflector zone 62. The second reflector zone 64 is radially to the exterior of the first reflector zone 62 relative to rotation axis 24. Thus, light module 60 can generate an emitted light distribution 52 with two spatially separated areas in the main direction of illumination 56.

Figure 11:
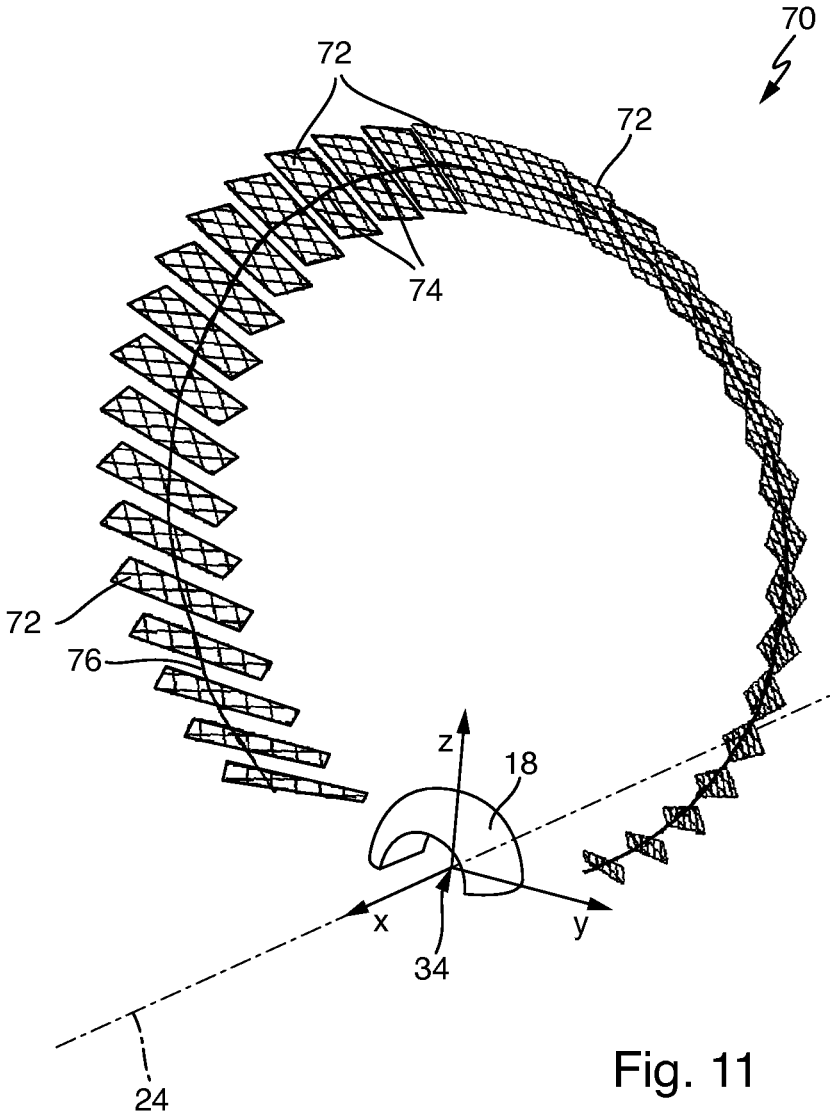
FIG. 11 another embodiment of a light module according to the invention.

FIG. 11 shows another light module 70 that has a number of reflector zones 72. Each of the reflector zones 72 is in turn embodied as a segment of the surface of an imaginary rotation-symmetric circular cone. However, in distinction from the examples shown above, the axis of symmetry of the various circular cones do not coincide in light module 70. Each reflector zone 72 contains a zone guide point 74, which is determined as the geometric center of the area in reflector zone 72 in the present example. The reflector zones 72 are positioned such that the zone guide points 74 fall on reflector guide curve 76. Reflector guide curve 76 is essentially circular and perpendicular to rotation axis 24. Furthermore, reflector guide curve 76 is designed such that it intersects rotation axis 24 in optical center 34. The symmetric circular cones underlying the respective reflector zones 72 as discussed have axis of symmetry that are parallel to rotation axis 24, but that are offset in a direction perpendicular to rotation axis 24 depending on the position of the associated zone guide point 74.

All of the reflector zones 72 may also be embodied as segments of surfaces of imaginary symmetric circular cones with an included angle of in particular 45° around rotation axis 24 (x-axis), where the imaginary circular cones are in each case offset against each other along the x-axis.

A reflector that consists of a number of reflector zones 72 in the manner shown in FIG. 11 could yield a variety of conceivable emitted light distributions depending on the design of the reflector zones 72.

In each case, the reflector zones 72 in FIG. 11, the reflector zones 62 and 64 in FIG. 10 or the reflector zone 54 in FIG. 9 may contain dispersing facets that disperse a portion of the light in a controlled manner.

The light modules of the invention may be designed such that a view along rotation axis 24 (in a direction into the light) will show no or just a minor coverage of the visible area with components of the light modules (such as reflector zones 54, 62, 64, 72 or lens element 18).

Consequently, it is possible, for example, to incorporate several light modules of the invention together in an illumination device without creating a shadow from one to the other. Thus, the individual light modules may be aligned offset from each other along a common rotation axis. It is also conceivable to have a design with several parallel offset rotation axis. Moreover, the various reflector zones 54, 62, 64, 72 may be designed such that the light emitted from one reflector zone is not obstructed by the other reflector zones. In particular, the light modules towards the front in the direction of emitted light have reflector zones in this arrangement with a greater radial distance from the rotation axis than the reflector zones towards the rear in the direction of emitted light. A further improvement of the design may have individual light modules that emit light of different colors.

A light module of the invention may also be incorporated in an illumination device ahead of an ornamental component. Given that the components of the light modules will obstruct the view along the rotation axis only to a minor degree or not at all, the ornamentation in the illumination device will be visible from the outside.

It is also conceivable that the light module of the inventions could be placed in an illumination device ahead of a conventional reflector covering a larger area.

The reflector zones 54, 62, 64, 72 may in each case be embodied as components of a covering frame that determines the optical design of the light module.

It should be appreciated by those having ordinary skill in the related art that the invention has been described above in an illustrative manner. It should also be appreciated that the terminology that has been used above is intended to be in the nature of words of description rather than of limitation and that many modifications and variations of the invention are possible in light of the above teachings. Thus, within the scope of the appended claims, the invention may be practiced other than as specifically described above.

What is claimed is:

1. A light module of an illumination device for a motor vehicle, comprising: at least one light source to emit light and a primary optical system associated with said light source to bundle the light emitted by said light source into primary light distribution as well as a reflector that is designed and positioned such that the primary light distribution may be redirected into emitted light distribution of said light module, wherein said primary optical system includes a lens element that is embodied as a sector of an imaginary rotation body formed by the rotation of an imaginary rotation base surface around a rotation axis, wherein said rotation base surface is embodied such that said lens element will have a light entry surface that faces the rotation axis and that surrounds the rotation axis and a light emitting surface that is radially exterior relative to the rotation axis, and wherein said reflector has at least one reflector zone that is embodied as a segment of the surface of a symmetric imaginary associated circular cone, wherein the axis of symmetry of the circular cone runs parallel to rotation axis of said lens element.

2. The light module according to claim 1, wherein said lens element is bordered by an external border in cross sections containing the rotation axis, wherein said border is convex relative to the rotation axis in the direction pointing away from the rotation axis.

3. The light module according to claim 1, wherein said rotation base surface is symmetric relative to a base axis of symmetry, wherein said base axis of symmetry is perpendicular to the rotation axis and intersects the same in optical center.

4. The light module according to claim 3, wherein said light source is located in the optical center.

5. The light module according to claim 3, wherein said rotation base surface is embodied such that an imaginary rotation body of the rotation base surface around the base axis of symmetry has the light-bundling properties of a converging lens, wherein the imaginary converging lens has a focal length such that the associated focus is on the rotation axis.

6. The light module according to claim 3, wherein said rotation base surface is embodied such that an imaginary rotation body of said rotation base surface around the base axis of symmetry has the light-bundling properties of an imaginary converging lens such that the imaginary converging lens can bundle a diverging light bundle originating in the focus of the rotation axis and the base axis of symmetry into focii concentrically surrounding the base axis of symmetry.

7. The light module according to claim 1, including a diverging light bundle emanating from said rotation axis that impacts on the light entry surface redirected to an emitted light bundle of light rays of the primary light distribution that are parallel in cross sections containing the rotation axis.

8. The light module according to claim 1, wherein the axis of symmetry of the imaginary associated circular cone of at least one reflector zone coincides with the rotation axis of said lens element.

9. The light module according to claim 1, wherein the reflector encompass at least a first reflector zone and a second reflector zone that are embodied as segments of the surfaces of a first and a second symmetric imaginary associated circular cone, wherein the first circular cone differs from the second circular cone.

10. The light module according to claim 9, including a reflector with a number of said reflector zones, wherein said reflector zones are arrayed along a non-linear or circular reflector guide curve.

* * * * *